US008066283B2

(12) United States Patent
Yamada

(10) Patent No.: US 8,066,283 B2
(45) Date of Patent: Nov. 29, 2011

(54) RECORDING DEVICE

(75) Inventor: Jun Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/078,260

(22) Filed: Apr. 1, 2011

(65) Prior Publication Data

US 2011/0248441 A1 Oct. 13, 2011

(30) Foreign Application Priority Data

Apr. 9, 2010 (JP) ..... 2010-090164

(51) Int. Cl.
*B65H 5/02* (2006.01)

(52) U.S. Cl. ..... 271/276

(58) Field of Classification Search ..... 271/197, 271/276; 347/104; 269/21; 248/362, 363; 451/388

See application file for complete search history.

(56) References Cited

U.S. PATENT DOCUMENTS 5,833,231 A * 11/1998 Schreiner ..... 271/197
6,270,074 B1 * 8/2001 Rasmussen et al. ..... 271/276
6,332,489 B1 * 12/2001 Kusano ..... 156/542
6,336,722 B1 * 1/2002 Wotton et al. ..... 347/102
6,357,869 B1 * 3/2002 Rasmussen et al. ..... 347/102
6,394,596 B1 * 5/2002 Wotton et al. ..... 347/104
6,543,948 B2 * 4/2003 Beehler et al. ..... 400/635
7,137,750 B2 11/2006 Fujioka et al.
RE39,441 E * 12/2006 Wotton et al. ..... 101/232

FOREIGN PATENT DOCUMENTS

JP 2002-205855 A 7/2002

* cited by examiner

*Primary Examiner* — Jeremy R Severson

(74) *Attorney, Agent, or Firm* — Global IP Counselors, LLP

(57) ABSTRACT

A recording device includes a plurality of holes formed in the medium support part, a suction unit configured to suck out air via the holes, closing members configured and arranged to move in a direction away from the holes, an urging unit configured to urge the closing members toward the holes, and a sliding member configured and arranged to slide in a direction intersecting a moving direction in which the closing members move. The sliding member is configured and arranged to contact the closing members, and by sliding the sliding member, at least one hole is switched between a state in which the hole is closed by the closing member and a state in which the hole is left open by the closing member.

5 Claims, 5 Drawing Sheets

RECORDING DEVICE

CROSS-REFERENCE TO RELATED APPLICATIONS

This application claims priority to Japanese Patent Application No. 2010-090164 filed on Apr. 9, 2010. The entire disclosure of Japanese Patent Application No. 2010-090164 is hereby incorporated herein by reference.

BACKGROUND

1. Technical Field

The present invention relates to a recording device comprising a medium support part for supporting a recording medium, a plurality of holes whose one end sides are formed in the side of the medium support part that supports the recording medium, and suction unit which are provided to the other end sides of the holes and which suck out the air over the medium support part via the holes.

In the present application, the term "recording device" includes inkjet printers, wire dot printers, laser printers, line printers, copy machines, fax machines, and other types of devices.

2. Related Art

In conventional practice, as shown in Japanese Laid-Open Patent Publication No. 2002-205855, a recording device comprises a medium support part (a platen) for supporting paper, one example of a recording medium, in a position facing a recording head. A plurality of suction holes are formed in the medium support part. Furthermore, the air above the medium support part can be sucked out via the suction holes by the suction force of a suction fan as the suction unit, and the paper on the medium support part can be held by suction on the medium support part. A shutter is also provided for switching the state of the suction holes between opened and closed. By sliding the shutter, some of the suction holes can be closed, while the other suction holes can be opened. Therefore, it has been possible to select the suction holes to be opened in accordance with the size of the paper in the width direction.

SUMMARY

However, the sliding shutter is configured to close the suction holes, and suction force acts on the shutter. Therefore, a gap forms readily with the suction holes, and the airtightness is low in the suction holes to be closed. When a force toward the suction holes is applied to the shutter to improve airtightness, the friction resistance during sliding increases. Therefore, there arises a risk that it will be difficult to slide the shutter. There is particularly a risk in cases in which sliding is done manually. In cases in which sliding is achieved by the power of a motor, a large motor must be used in order to increase the output of the motor.

The present invention was devised in view of such circumstances, and an object thereof is to provide a recording device which takes into account the switching between opening and closing of the holes for suction formed in the medium support part, as well as the airtightness when the holes have been closed.

To achieve the object described above, a recording device of a first aspect of the present invention includes a medium support part, a plurality of holes formed in the medium support part, a suction unit, a plurality of closing members, an urging unit, and a sliding member. The medium support part is configured and arranged to support a recording medium.

One end sides of the holes are formed in a side of the medium support part that supports the recording medium. The suction unit is provided to the other end sides of the holes to suck out air above the medium support part via the holes. The closing members are provided to the other end sides of the holes, and configured and arranged to move in a movement direction away from the holes. The urging unit is configured and arranged to urge the closing members toward the holes. The sliding member is provided to the other end sides of the holes, and configured and arranged to slide in a sliding direction intersecting the movement direction in which the closing members move. The sliding member has first portions configured and arranged to contact the closing members during sliding. The closing members have second portions configured and arranged to contact the first portions when the sliding member slides. At least one of the first portions and the second portions has locations formed at an incline in relation to both the sliding direction in which the sliding member slides and the movement direction in which the closing members move. By sliding the sliding member, at least one of the holes is switched between a state in which the first portion is separated from the second portion and the closing member closes up the hole, and a state in which the first portion is brought in contact with the second portion, the closing member moves in the movement direction away from the hole, and the closing member opens up the hole. The holes to be put into the opened state is selected by changing a position of the sliding member in the sliding direction.

According to the first aspect of the present invention, the closing members and the sliding member are separate members. Therefore, in a state in which the closing members have closed the holes, the positions of the closing members are not affected even when the suction force from the suction unit acts on the sliding member. The airtightness in the closed state can thereby be improved. As a result, there is no risk of a loss of suction force via the holes in the opened state. Specifically, the recording medium can be efficiently held by suction on the medium support part within a range that faces the holes selected for the opened state.

By keeping the closing members and the sliding member as separate members, the sliding member can be slid more readily in comparison with the sliding of the conventional shutter. Therefore, the hole selection can be switched easily. This is particularly effective in cases in which the sliding member is slid manually.

A recording device according to the second aspect of the present invention is the first aspect, wherein, using as a reference the front and back of the sliding direction when the sliding member is slid in a direction in which the first portions move from being separated from the second portions to being in contact with the second portions, distal end sides of the first portions in the sliding member are preferably formed at an incline relative to the sliding direction so as to be nearer to the holes than the rear end sides.

According to the second aspect of the present invention, in addition to the same operational effects as the first aspect, the closing members can be moved smoothly in a direction away from the holes. Specifically, it is possible to smoothly switch from the closed state to the opened state.

A recording device according to the third aspect of the present invention is the first or second aspect, wherein at least hole-facing sides of the closing members are preferably formed into spherical surfaces, the holes are preferably circular holes, and diameters of the spherical portions in the closing members are preferably larger than diameters of the holes.

According to the third aspect of the present invention, in addition to the same operational effects as the first or second aspect, the airtightness in the closed state can be further improved. Specifically, the holes can be reliably put into the closed state even despite a change in the orientation of the closing members, the movement direction of the closing members being the axis; or even despite a change in the alignment of the closing members relative to the movement direction.

The first portions of the sliding member can also be configured so as to readily fit in between the second portions of the closing members and the holes.

A recording device according to the fourth aspect of the present invention is any of the first through third aspects, wherein the sliding member preferably has grooves extending in the sliding direction. The grooves preferably have first areas whose widths relative to the sliding direction are narrower than widths of the second portions in the closing members, and second areas wider than the widths of the second portions.

According to the fourth aspect of the present invention, in addition to the same operational effects as any of the first through third aspects, the positions and alignments of the closing members in the opened state can be stabilized.

Specifically, the opened state can be enacted when the second portions of the closing members are in contact with the grooves in the first areas, and the closed state can be enacted when the second portions of the closing members are positioned in the second areas. In the opened state, the grooves come in contact with the closing members, and the positions and alignments of the closing members can be stabilized. Their positions can be stabilized particularly in the sliding direction of the sliding member and in a direction intersecting the movement direction of the closing members.

A recording device according to the fifth aspect of the present invention is any of the first through fourth aspects, preferably further including guide parts configured to guide the closing members in the movement direction. The closing members are preferably spherical members. The urging unit is preferably compression coil springs. Surfaces of the guide parts are preferably configured and arranged to contact the closing members being formed as inside surfaces of cylinders. The spherical members as the closing members and the compression coil springs as the urging unit are preferably provided to insides of the guide parts According to the fifth aspect of the present invention, in addition to the same operational effects as any of the first through fourth aspects, it is possible to stabilize the relative positional relationship between the holes and the closing members in a direction orthogonal to the movement direction of the closing members. Since the closing members are spherical, the closed state can be enacted readily even when the orientations and alignments of the closing members have changed.

BRIEF DESCRIPTION OF THE DRAWINGS

Referring now to the attached drawings which form a part of this original disclosure.

DETAILED DESCRIPTION OF EXEMPLARY EMBODIMENTS

Embodiments of the present invention are described hereinbelow based on the drawings.

Figure 1A:
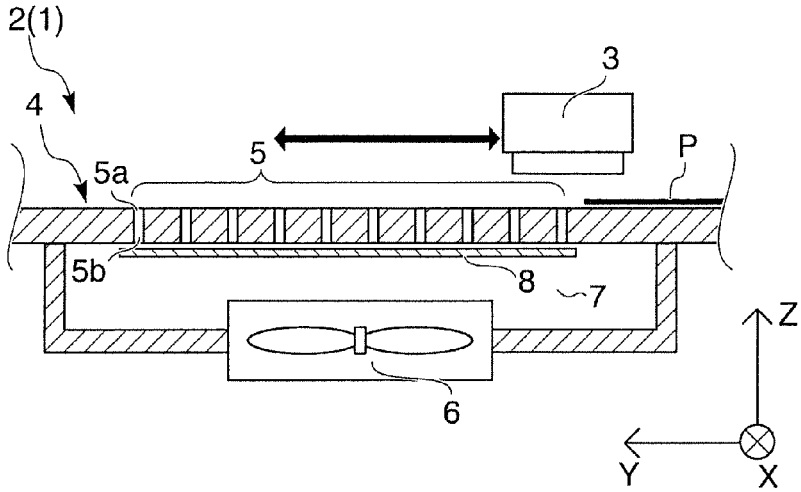
FIGS. 1A and 1B are drawings schematically showing the medium support part in a printer according to the present invention.
Figure 1B:
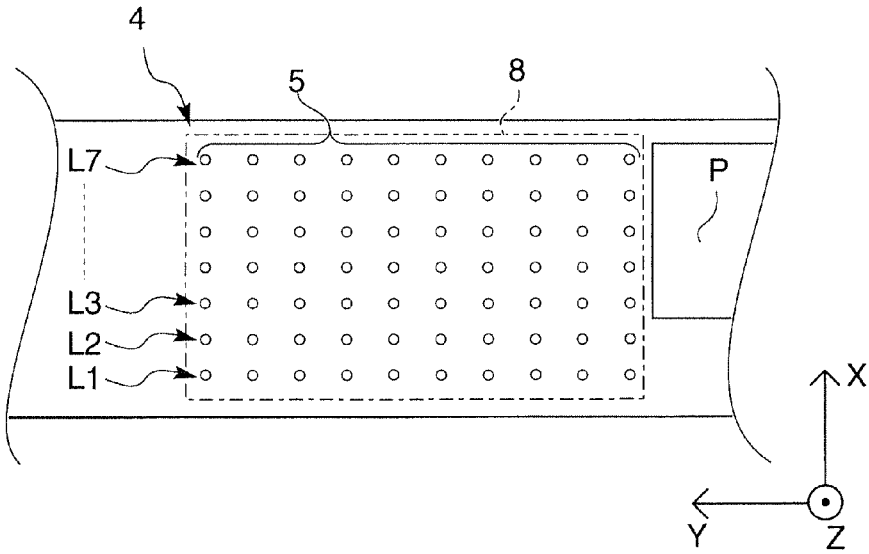

FIGS. 1A and 1B are drawings schematically depicting a medium support part in a printer according to the present invention. FIG. 1A is a side cross-sectional view. FIG. 1B is a plan view.

A printer 1 of the present invention, as shown in FIG. 1A, comprises a feeding unit (not shown) and a recording part 2. Of these, the feeding unit is configured so as to be capable of feeding paper P, one example of the recording medium, downstream in a feeding direction. For example, the paper can be fed by a pair of rollers or a belt mechanism.

The recording part 2 is configured so as to be capable of discharging ink and performing recording on the paper P. Specifically, the recording part 2 has a recording head 3 and a medium support part 4. In the present embodiment, the recording head 3 is provided so as to be capable of moving in a feeding direction Y of the paper P within a range facing the medium support part 4.

The recording head 3 may of course also be configured so as to be capable of moving in a width direction X of the paper P.

The medium support part 4 supports the paper P, and is configured so that the distance between the paper P and the recording head 3 can be kept at a predetermined distance. The medium support part 4 also has a plurality of holes 5, 5 . . . , a negative pressure chamber 7, and a suction unit 6. One end side 5*a* of the holes 5, 5 . . . is formed in the surface of the medium support part 4 that supports the paper P. The other end side 5*b* of the holes 5 is formed in the opposite side of the supporting surface, which is the side facing the negative pressure chamber.

The negative pressure chamber 7 is configured so as to be brought to a state of negative pressure by a suction fan, one example of the suction unit 6. On the hole-facing side of the negative pressure chamber 7, a sliding member 8 capable of sliding in the width direction X of the paper P is provided. As will be described in detail hereinafter, the configuration is designed so that the holes 5, 5 . . . can be switched between an opened state and a closed state by moving the sliding member 8.

A plurality of holes 5 are provided along the feeding direction Y as shown in FIG. 1B. Furthermore, the holes are formed in a plurality of rows in the width direction X of the paper P. In the present embodiment, a first row L1, a second row L2, a third row L3, and so forth up through a seventh row L7 are aligned from one end side to the other end side of the width direction X.

A Z-axis direction is a direction in which the recording head and the medium support part face each other.

Next is a description of the action of moving the sliding member 8 and switching the holes 5, 5 . . . between an opened state and a closed state.

First Selection State

Figure 2A:
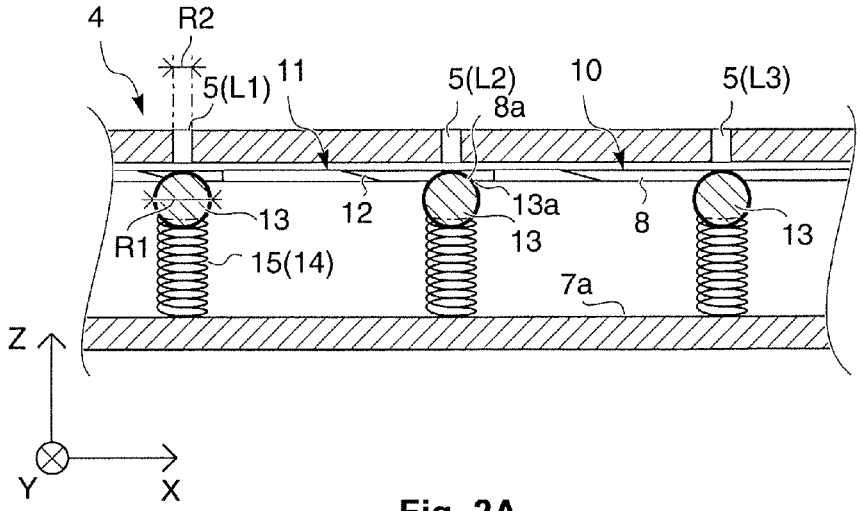
FIGS. 2A and 2B are schematic drawings showing a first selection state of the holes of the medium support part according to the present invention.
Figure 2B:
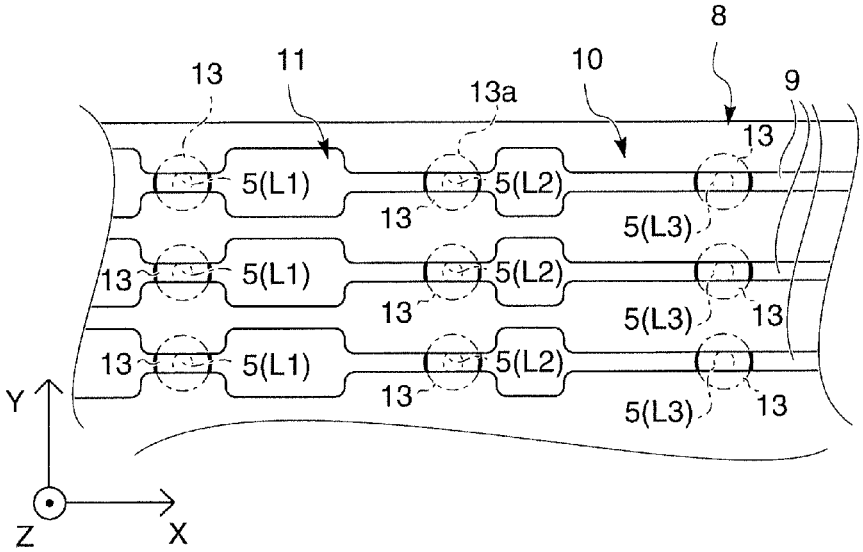

FIGS. 2A and 2B are schematic drawings showing a first selection state of the holes of the medium support part according to the present invention. Of these drawings, FIG. 2A is a cross-sectional view showing an enlargement of the main part of the medium support part when viewed from the upstream side toward the downstream side in the feeding direction. The suction unit are not shown in FIG. 2A in order to make the drawing easier to understand.

FIG. 2B is a plan view showing the positional relationship between the sliding member and the closing member. To make the drawing easier to understand in FIG. 2B, the surface of the medium support part that supports the paper, which is the top surface side of the negative pressure chamber, is not shown.

The term "first selection state" refers to a state in which the holes are in an opened state throughout all the rows containing the plurality of holes. In other words, it refers to a state in which the opened state has been selected for all of the rows.

Spherical closing members 13 are provided to positions facing the other end sides 5*b* of the holes 5, as shown in FIGS. 2A and 2B. The closing members 13 are provided to be capable of moving in a direction away from the holes 5. The diameter R1 of each of the spherical closing members 13 is configured to be greater than the diameter R2 of each of the circular holes 5. The closing members 13 come in contact with the holes 5, thereby putting the holes 5 into the closed state. The closing members 13 are also configured to separate from the holes 5, thereby putting the holes 5 into the opened state.

The closing members 13 are urged from the bottom surface (7*a*) of the negative pressure chamber 7 toward the top surface by compression coil springs 15, which are one example of an urging unit 14. The closing members 13 are spherical in shape and are configured so that the length of the diameter R1 of each of the spheres is greater than the length of the diameter of each of the compression coil springs 15. Therefore, the sphere surfaces are stably supported by the distal ends of the compression coil springs 15. Since the closing members 13 are spherical, it is not a problem when the closing members 13 become displaced in a rotational direction whose axis is the movement direction of the closing members 13. Furthermore, it is also not a problem when the alignments of the closing members 13 relative to the movement direction have changed.

Furthermore, the sliding member 8 is configured so as to be capable of sliding in the width direction X while being guided by a guide (not shown).

Grooves 9 extending along the width direction X are formed in the sliding member 8. The configuration is designed so that the grooves 9 can come in contact with the closing members 13 and cause the closing members 13 to move in a direction away from the holes 5. In other words, the sliding member 8 acts as a cam on the closing members 13 and the closing members 13 bear the action of the sliding member 8 as cam followers, thus constituting a so-called cam mechanism. The locations where the sliding member 8 comes in contact with the closing members 13 are denoted as first portions 8*a*. The locations where the closing members 13 come in contact with the sliding member 8 are denoted as second portions 13*a*.

Specifically, the grooves 9 have first areas 10 and second areas 11. Of these areas, the width of each of the first areas 10 relative to the sliding direction is configured to be narrower (shorter) than the length of the spherical diameter R1 of each of the closing members 13. The width of each of the second areas 11 relative to the sliding direction is configured to be wider (longer) than the length of the spherical diameter R1 of each of the closing members 13.

The widths of the second areas 11 are preferably designed to be greater than the widths of the first areas 10, and are also preferably designed to be greater than the widths of the second portions 13*a* of the closing members 13. Specifically, the configuration is preferably designed so that the sliding member 8 and the closing members 13 do not come in contact in the second areas 11 of the grooves 9.

The distal end side of the sliding member 8 in the sliding direction when the holes 5 are switched from the closed state to the opened state is designed as having a tapering shape in the vicinities of the borders between the first areas 10 and the second areas 11. In other words, first inclined parts 12, which are inclined relative to the sliding direction so that their distal end sides are nearer to the holes 5 than their rear end sides, are formed in the first portions 8*a* on the distal end sides of the first areas 10 in the sliding direction.

In the first selection state, the first areas 10 of the grooves 9 are configured so as to fit in between the holes 5 and the closing members 13 in all of the first through seventh rows L1 to L7. In other words, the first portions 8*a* of the first areas 10 of the grooves 9 are configured so as to separate the closing members 13 from the holes 5 against the spring force of the compression coil springs 15. Therefore, in all of the first through seventh rows L1 to L7, the holes 5 are in the opened state.

In the present embodiment, a gap is provided between the top surface of the negative pressure chamber 7 and the sliding member 8, but the present invention is not limited to this configuration. The air sucked in from the holes 5 in the opened state is sucked in by the suction unit 6 via the grooves 9 of the sliding member 8. Therefore, a gap need not be provided between the top surface of the negative pressure chamber 7 and the sliding member 8.

Second Selection State

Figure 3A:
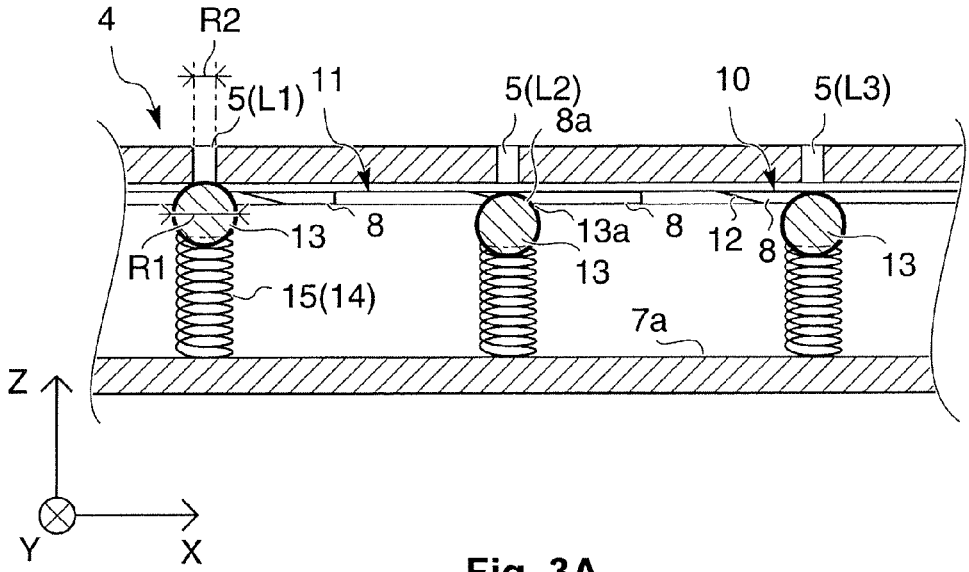
FIGS. 3A and 3B are schematic drawings showing a second selection state of the holes of the medium support part according to the present invention.
Figure 3B:
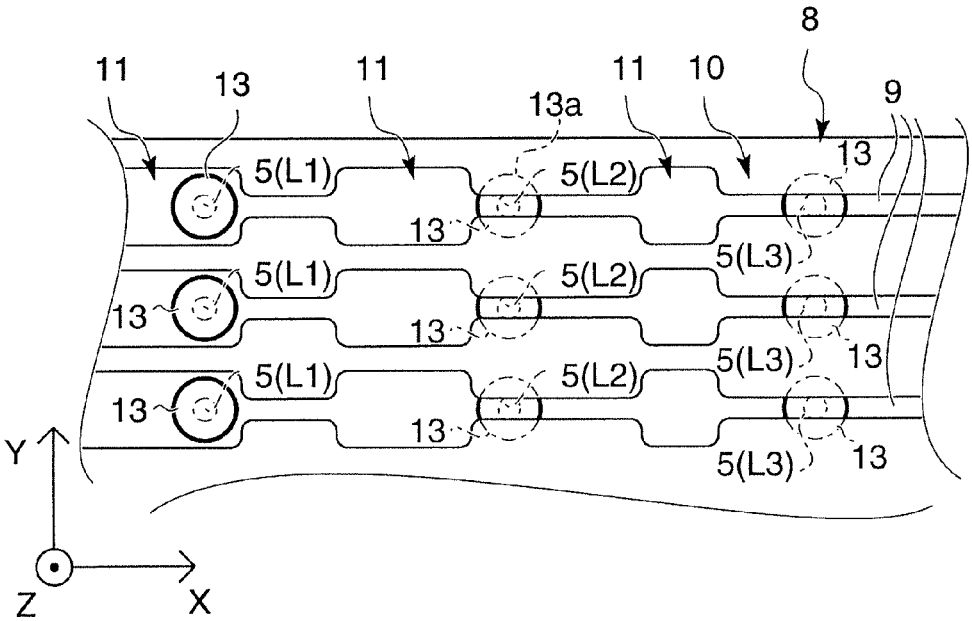

FIGS. 3A and 3B are schematic drawings showing the second selection state of the holes of the medium support part according to the present invention. Of these drawings, FIG. 3A is a cross-sectional view showing an enlargement of the main part of the medium support part when viewed from the upstream side toward the downstream side in the feeding direction. The suction unit are not shown in FIG. 3A in order to make the drawing easier to understand.

FIG. 3B is a plan view showing the positional relationship between the sliding member and the closing members. To make the drawing easier to understand in FIG. 3B, the surface of the medium support part that supports the paper, which is the top surface side of the negative pressure chamber, is not shown.

The term "second selection state" refers to a state in which the holes are in an opened state in all of the rows except the first row among the rows of holes. In other words, it refers to a state in which the first row is in the closed state and the opened state has been selected for the other rows (the second through seventh rows).

When the sliding member 8 is slid from the state in FIGS. 2A and 2B in the direction of the X-axis arrow as shown in FIGS. 3A and 3B, the closing members 13 of the first row L1 can switch the holes 5 of the first row L1 to the closed state. To be more specific, the sliding member 8 is slid in the direction of the X-axis arrow. The closing members 13 corresponding to the holes 5 of the first row L1 thereby move relatively from the first areas 10 into the grooves of the second areas 11. At this time, the closing members 13 corresponding to the holes 5 of the other rows are in contact with the grooves 9 of the first areas 10.

Therefore, only the closing members 13 corresponding to the holes 5 of the first row L1 approach the holes 5 of the first row L1 due to the spring force of the compression coil springs 15. Only the closing members 13 corresponding to the holes 5 of the first row L1 come in contact with the holes 5 of the first row L1, putting the holes 5 of the first row L1 into the closed state. Specifically, the second selection state is enacted, wherein the first row L1 is in the closed state and the opened state is selected for the other rows (the second through seventh rows L2 to L7).

Third Selection State

Figure 4A:
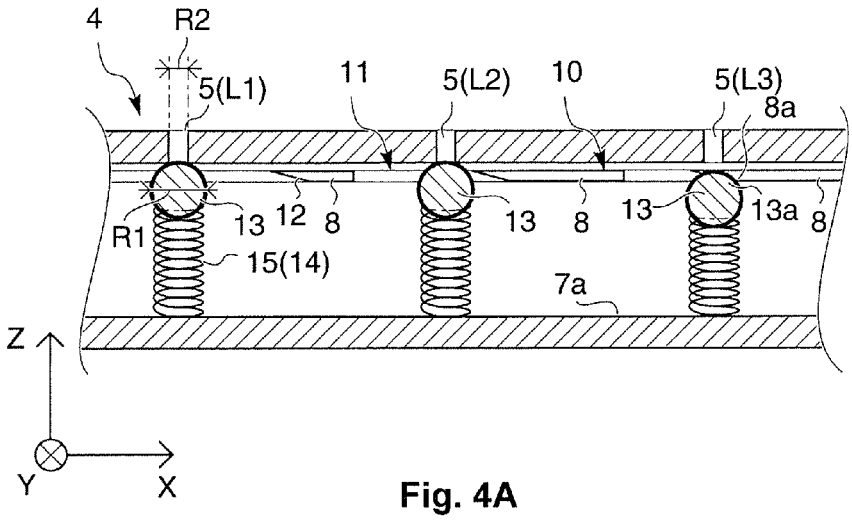
FIGS. 4A and 4B are schematic drawings showing a third selection state of the holes of the medium support part according to the present invention.
Figure 4B:
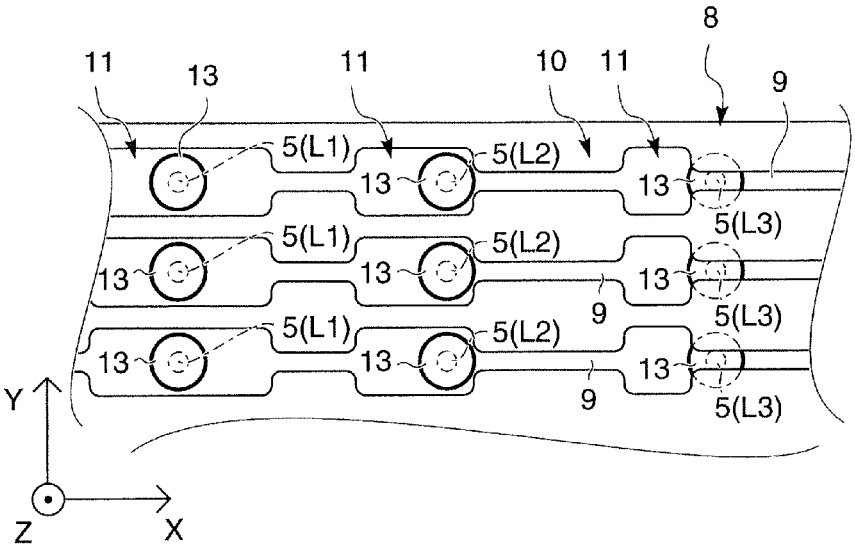

FIGS. 4A and 4B are schematic drawings showing the third selection state of the holes of the medium support part according to the present invention. Of these drawings, FIG. 4A is a cross-sectional view showing an enlargement of the main part of the medium support part when viewed from the upstream side toward the downstream side in the feeding direction. The suction unit are not shown in FIG. 4A in order to make the drawing easier to understand.

FIG. 4B is a plan view showing the positional relationship between the sliding member and the closing member. To make the drawing easier to understand in FIG. 4B, the surface of the medium support part that supports the paper, which is the top surface side of the negative pressure chamber, is not shown.

The term "third selection state" refers to a state in which the holes are in an opened state in all of the rows except the first and second rows among the rows of holes. In other words, it refers to a state in which the first and second rows are in the closed state and the opened state has been selected for the other rows (the third through seventh rows).

When the sliding member 8 is slid from the state in FIGS. 3A and 3B in the direction of the X-axis arrow as shown in FIGS. 4A and 4B, the closing members 13 of the second row L2 can switch the holes 5 of the second row L2 to the closed state. To be more specific, the sliding member 8 is slid further in the direction of the X-axis arrow. The closing members 13 corresponding to the holes 5 of the second row L2 thereby move relatively from the first areas 10 into the grooves of the second areas 11. At this time, the closing members 13 corresponding to the holes 5 of the third through seventh rows L3 to L7 are in contact with the grooves 9 of the first areas 10. The closing members 13 corresponding to the holes 5 of the first row L1 remain relatively inside the grooves of the second areas 11.

Therefore, the closing members 13 corresponding to the holes 5 of the second row L2 approach the holes 5 of the second row L2 due to the spring force of the compression coil springs 15. The closing members 13 corresponding to the holes 5 of the second row L2 come in contact with the holes 5 of the second row L2, putting the holes 5 of the second row L2 into the closed state. Specifically, the third selection state is enacted, wherein the first and second rows L1 and L2 are in the closed state and the opened state is selected for the other rows (the third through seventh rows L3 to L7).

Fourth Selection State (Not Shown)

The term "fourth selection state" refers to a state in which the holes are in the opened state in all of the rows except the first through third rows among the rows of holes. In other words, it refers to a state in which the first through third rows are in the closed state and the opened state has been selected for the other rows (the fourth through seventh rows).

When the sliding member 8 is slid further in the X-axis arrow direction from the state of FIGS. 4A and 4B, the closing members 13 of the third row L3 can switch the holes 5 of the third row L3 to the closed state. The action of the closing members 13 corresponding to the holes 5 of the third row L3 is the same as the action of the closing members 13 corresponding to the holes 5 of the second row L2 when switching from the second selection state to the third selection state. Therefore, the description of this action is omitted.

The present embodiment is configured such that the holes 5 of the first through third rows L1 to L3 can be switched by a single sliding member 8 between the opened state and the closed state in this example, but the present invention is not limited to this example. The configuration may also of course be designed so that the holes 5 of the first through sixth rows L1 to L6 can be switched. In the case of a configuration in which the paper P is positioned using its seventh row facing side as a reference, there is no need for the seventh row L7 to be switched. This is because the suction unit 6 is preferably stopped instead of switching the holes 5 of all the rows to the closed state.

In the present embodiment, the configuration has first through seventh rows L1 to L7, but the present invention is not limited to this configuration. The number of rows can of course be increased.

As described above, the airtightness of the closed state can be improved in comparison with the prior art by configuring the sliding member 8 separately from the closing members 13 whose holes 5 are in the closed state. This is because the closing members 13 in the closed state are separated from the sliding member 8 even when the sliding member 8 is being affected by the suction force. As a result, there is no risk of the suction force decreasing in the holes 5 in the opened state.

When the switch is made from the opened state to the closed state, smoother sliding can be achieved in comparison with the prior art previously described. This is because there is no force urging a shutter toward the holes in order to improve airtightness as in the prior art previously described.

Switching From Closed State to Opened State

When a switch is made from the "fourth selection state" to the "third selection state," the sliding member 8 is slid in the opposite direction of the X-axis arrow. At this time, the closing members 13 corresponding to the holes 5 of the third row L3 relatively move out of the grooves of the second areas 11 and come in contact with the grooves 9 of the first areas 10. To be more specific, the first inclined parts 12 as cams come in contact with the second portions 13*a* as cam followers of the closing members 13 corresponding to the holes 5 of the third row L3.

The first inclined parts 12 then cause the closing members 13 corresponding to the holes 5 of the third row L3 to move in a direction away from the holes 5 of the third row L3 against the spring force of the compression coil springs 15.

As a result, the closing members 13 of the third row L3 put the holes 5 of the third row L3 into the opened state. At this time, the closing members 13 corresponding to the holes 5 of the first and second rows L1 and L2 remain positioned relatively inside the grooves of the second areas 11. Therefore, the holes 5 of the first and second rows L1 and L2 remain in the closed state.

Similarly, when a switch is made from the "third selection state" to the "second selection state," the sliding member 8 is slid from the state shown in FIGS. 4A and 4B in the opposite direction of the X-axis arrow. At this time, the closing members 13 corresponding to the holes 5 of the second row L2 move relatively out of the grooves of the second areas 11 and come in contact with the grooves 9 of the first areas 10. To be more specific, the first inclined parts 12 as cams come in contact with the second portions 13*a* as cam followers of the closing members 13 corresponding to the holes 5 of the second row L2. The first inclined parts 12 then cause the closing members 13 corresponding to the holes 5 of the second row L2 to move in a direction away from the holes 5 of the second row L2 against the spring force of the compression coil springs 15.

As a result, the closing members 13 of the second row L2 put the holes 5 of the second row L2 into the opened state as shown in FIGS. 3A and 3B. At this time, the closing members 13 corresponding to the holes 5 of the first row L1 remain positioned relatively inside the grooves of the second areas 11. Therefore, the holes 5 of the first row L1 remain in the closed state. The closing members 13 corresponding to the holes 5 of the third row L3 also remain in contact with the grooves 9 of the first areas 10. Therefore, the holes 5 of the third row L3 remain in the opened state.

Similarly, when a switch is made from the "second selection state" to the "first selection state," the sliding member 8 is slid in the opposite direction of the X-axis arrow from the state shown in FIGS. 3A and 3B. The action of the closing members 13 corresponding to the holes 5 of the first row L1 at this time is the same as the action of the closing members 13 corresponding to the holes 5 of the second row L2 when switching from the third selection state to the second selection state. Therefore, the description of this action is omitted.

As a result, the closing members 13 of the first row L1 put the holes 5 of the first row L1 into the opened state as shown in FIGS. 2A and 2B. At this time, the closing members 13 corresponding to the holes 5 of the second and third rows L2 and L3 remain in contact with the grooves 9 of the first areas 10. Therefore, the holes 5 of the second and third rows L2 and L3 remain in the opened state.

As described above, when a switch is made from the closed state to the opened state, the closing members 13 can be smoothly separated from the holes 5 by the first inclined parts 12. The second portions 13*a* in the closing members 13 are also inclined relative to the sliding direction. Therefore, the closing members 13 can be smoothly separated from the holes 5.

In the embodiment described above, the closing members 13 are formed into spherical shapes, but are not limited to such. It is preferable that at least the hole-facing sides be formed into spherical shapes. This is to allow airtightness with the circular holes 5 to be improved. The hole-facing sides need not be spherical. This is because it is possible to close up the holes.

In the embodiment described above, grooves 9 were formed in the sliding member 8, but forming the grooves 9 is not absolutely necessary. A cam mechanism is preferred in which a relationship is established between the sliding member 8 as a cam and the closing members 13 as cam followers. The reason the grooves 9 are provided in the present embodiment is to allow the positions of the closing members 13 in the opened state to be stabilized.

Furthermore, in the present embodiment, the sliding member 8 is configured to slide in the X-axis direction, but is not limited to this configuration. The sliding member 8 may slide in a direction intersecting the Z-axis direction, which is the movement direction of the closing members 13. This is because with an intersecting relationship, the relationship between cam and cam follower can be established.

The configuration was designed so that the opened/closed state of the holes of all the rows was switched according to the paper width alone, but the configuration may also be designed so that the opened/closed state is switched according to the paper length as well. It is possible to adapt to the length of the paper as well by forming the grooves downstream in the feeding direction and the grooves upstream into different shapes. For example, in the case of a configuration in which recording is performed while the paper fed to the medium support part has been stopped on the medium support part, when the paper is size A4, holes can be opened in a range corresponding to size A4 paper. When the paper is size A3, holes can be opened in a range corresponding to size A3 paper.

The printer 1 as the recording device of the present embodiment comprises a medium support part 4 for supporting paper P, one example of a recording medium; a plurality of holes 5, 5 . . . formed in the medium support part 4, one end sides 5*a* of the holes being formed in a side of the medium support part 4 that supports the paper P; suction unit 6 which are provided to the other end sides 5*b* of the holes 5 and which suck out air above the medium support part via the holes 5; a plurality of closing members 13 which are provided to the other end sides 5*b* of the holes 5 and which are capable of moving in a Z-axis direction, which is a direction away from the holes 5; urging unit 14 for urging the closing members 13 toward the holes 5; and a sliding member 8 which is provided to the other end sides 5*b* of the holes 5 and which is capable of sliding in a width direction X, which is an example of a direction that intersects the direction in which the closing members 13 move; the printer 1 characterized in that the sliding member 8 has first portions 8*a* capable of coming in contact with the closing members 13 during sliding; the closing members 13 have second portions 13*a* for coming in contact with the first portions 8*a* when the sliding member 8 slides; at least one of the first portions 8*a* and the second portions 13*a* have locations formed at an incline in relation to both the direction in which the sliding member 8 slides and the direction in which the closing members 13 move; by sliding the sliding member 8, at least one of the holes 5 can be switched between a state in which the first portion 8*a* is separated from the second portion 13*a* and the closing member 13 closes up the hole 5, and a state in which the first portion 8*a* is brought in contact with the second portion 13*a*, the closing member 13 moves in a direction away from the hole 5, and the closing member 13 opens up the hole 5; and the holes 5 to be put into the opened state are selected by changing the position of the sliding member 8 in the sliding direction.

In the present embodiment, the second portions 13*a* are formed into spherical surfaces and are inclined relative to both the sliding direction (the X-axis direction) and the movement direction (the Z-axis direction).

The present embodiment is also characterized in that, using as a reference the front and back of the sliding direction when the sliding member 8 is slid in a direction in which the first portions 8*a* move from being separated from the second portions 13*a* to being in contact with the second portions 13*a*, the first inclined parts 12 of the first portions 8*a* in the sliding member 8 are formed at an incline relative to the sliding direction so that their distal end sides are nearer to the holes 5 than their rear end sides.

Furthermore, in the present embodiment, at least the hole-facing sides of the closing members 13 are formed into spherical surfaces, the holes 5 are circular holes, and the diameters R1 of the spherical portions in the closing members 13 are larger than the diameters R2 of the holes 5.

The present embodiment is also characterized in that the sliding member 8 has grooves 9 extending in the sliding direction; and the grooves 9 have first areas 10 whose widths relative to the sliding direction are narrower than the widths of the second portions 13*a* in the closing members 13, and second areas 11 wider than the widths of the second portions 13*a*.

Other Embodiment 1

Figure 5A:
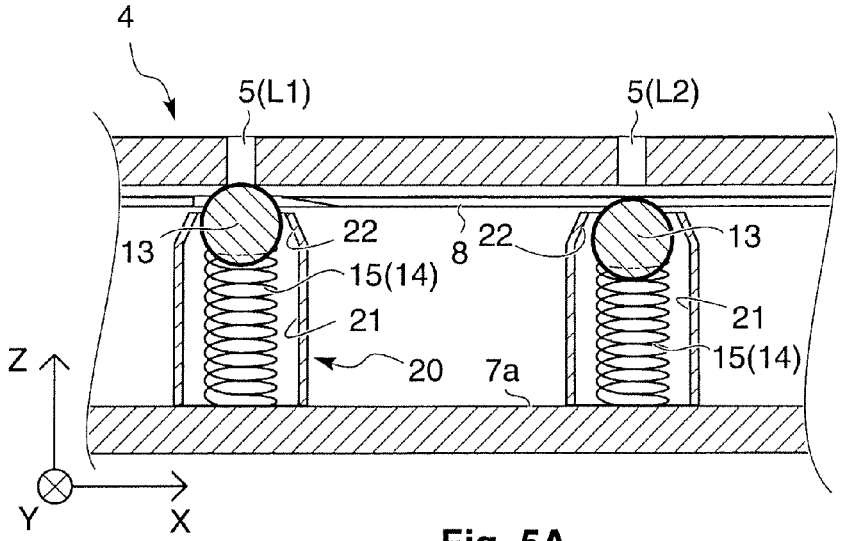
FIGS. 5A and 5B are schematic drawings showing the opened and closed states of holes of another embodiment.

FIG. 5A is a schematic side view showing the opened and closed states of the holes according to another embodiment 1.

In the other embodiment 1 as shown in FIG. 5A, guide parts are provided for guiding the closing members in a direction away from the holes.

Since the other components are identical to those of the embodiment previously described, the same symbols are used and descriptions thereof are omitted.

Guide parts 20 are formed into cylindrical shapes whose axes are in the Z-axis direction. The closing members 13 and the compression coil springs 15 are placed inside the cylindrical shapes. The inside surfaces 21 of the cylindrical shapes of the guide parts 20 are configured so as to be capable of guiding the closing members 13. Tapering second inclined parts 22 are formed in the sides of the inside surfaces 21 near the holes 5. When a switch is made to the closed state, the second inclined parts 22 can thereby guide the closing members 13 to positions facing the holes 5. Specifically, the relative positional relationship between the holes 5 and the closing members 13 in the X-Y axis directions can be established with precision. As a result, the airtightness in the closed state can be further improved.

The diameters of the ends of the sides near the holes 5 in the inside surfaces 21 of the cylindrical guide parts 20 (the ends of the second inclined parts 22) are configured so as to be smaller than the diameters R1 of the spherical closing members 13. The closing members 13 can thereby be prevented from coming entirely out of the guide parts 20. In other words, there is no risk of losing the closing members 13.

In the closed state, there are slight gaps between the closing members 13 and the ends near the holes 5 in the inside surfaces 21 of the cylindrical guide parts 20. This is to ensure that the closing members 13 firmly cover the holes 5 by spring force.

Furthermore, the second inclined parts 22 are formed on the inside surfaces 21 of the guide parts 20 but are not limited to such. Even in a configuration without the second inclined parts 22, the relative positional relationship between the holes 5 and the closing members 13 in the X-Y axis directions can be established with precision by configuring the diameters R1 of the closing members 13 to be slightly smaller than the inside diameters of the cylindrical guide parts 20.

The other embodiment 1 is characterized in further comprising guide parts 20 for guiding the closing members 13 in the movement direction, wherein the closing members 13 are spherical; the urging unit 14 are the compression coil springs 15; the inside surfaces 21 of the guide parts 20, which are the surfaces capable of coming in contact with the closing members 13, are formed as inside surfaces of cylinders; and the spheres as the closing members 13 and the compression coil springs 15 as the urging unit 14 are provided to the insides of the guide parts 20.

Other Embodiment 2

Figure 5B:
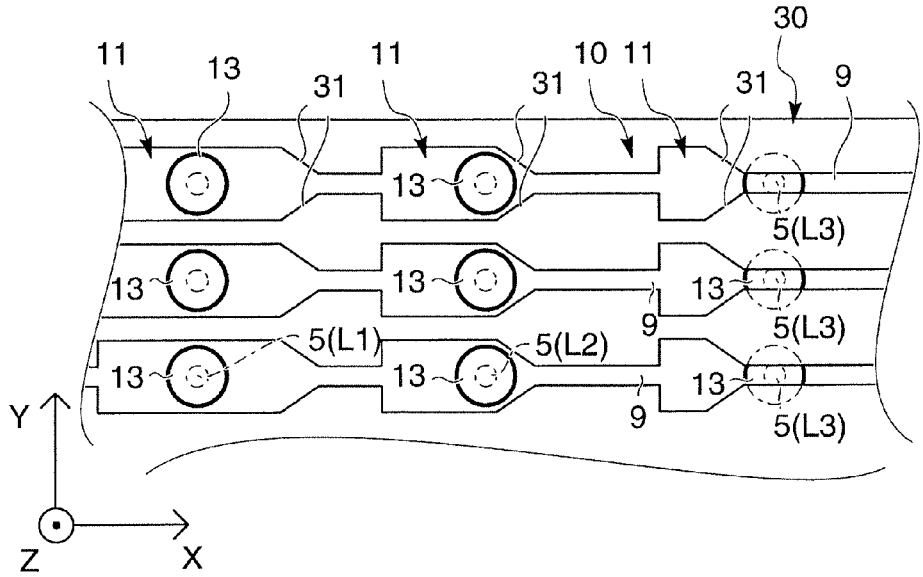

FIG. 5B is a schematic plan view showing the shapes of the grooves of the sliding member according to another embodiment 2. To make FIG. 5B easier to understand, the surface supporting the paper in the medium support part, which is the top surface side of the negative pressure chamber, is not shown.

A sliding member 30 according to the other embodiment 2 has third inclined parts 31 in the vicinities of the borders between the first areas 10 and the second areas 11, as shown in FIG. 5B.

Since the other components are identical to those of the embodiment previously described, the same symbols are used and descriptions thereof are omitted.

In the third inclined parts 31, the distal end sides in the sliding direction of the sliding member 30 when the holes 5 are switched from the closed state to the opened state are provided so that the grooves 9 increase in width.

Therefore, the same operational effects as those of the first inclined parts 12 of the embodiment previously described can be obtained. Specifically, the holes 5 can be switched smoothly from the closed state to the opened state.

The present invention is not limited to the embodiments described above, various modifications can be made within the scope of the invention defined in the claims, and such modifications are of course included within the scope of the invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a medium support part configured and arranged to support a recording medium;

a plurality of holes formed in the medium support part, one end sides of the holes being formed in a side of the medium support part that supports the recording medium;

a suction unit provided to the other end sides of the holes to suck out air above the medium support part via the holes;

a plurality of closing members provided to the other end sides of the holes, and configured and arranged to move in a movement direction away from the holes;

an urging unit configured and arranged to urge the closing members toward the holes; and a sliding member provided to the other end sides of the holes, and configured and arranged to slide in a sliding direction intersecting the movement direction in which the closing members move, the sliding member having first portions configured and arranged to contact the closing members during sliding, the closing members having second portions configured and arranged to contact the first portions when the sliding member slides, at least one of the first portions and the second portions having locations formed at an incline in relation to both the sliding direction in which the sliding member slides and the movement direction in which the closing members move, by sliding the sliding member, at least one of the holes being switched between a state in which the first portion is separated from the second portion and the closing member closes up the hole, and a state in which the first portion is brought in contact with the second portion, the closing member moves in the movement direction away from the hole, and the closing member opens up the hole, and the holes to be put into the opened state being selected by changing a position of the sliding member in the sliding direction.

2. The recording device according to claim 1, wherein using as a reference the front and back of the sliding direction when the sliding member is slid in a direction in which the first portions move from being separated from the second portions to being in contact with the second portions, distal end sides of the first portions in the sliding member are formed at an incline relative to the sliding direction so as to be nearer to the holes than the rear end sides.

3. The recording device according to claim 1, wherein at least hole-facing sides of the closing members are formed into spherical surfaces, the holes are circular holes, and diameters of the spherical portions in the closing members are larger than diameters of the holes.

4. The recording device according to claim 1, wherein the sliding member has grooves extending in the sliding direction, the grooves having first areas whose widths relative to the sliding direction are narrower than widths of the second portions in the closing members, and second areas wider than the widths of the second portions.

5. The recording device according to claim 1, further comprising guide parts configured to guide the closing members in the movement direction, the closing members being spherical members, the urging unit being compression coil springs, surfaces of the guide parts configured and arranged to contact the closing members being formed as inside surfaces of cylinders, and the spherical members as the closing members and the compression coil springs as the urging unit being provided to insides of the guide parts.

* * * * *